US005921134A

United States Patent [19]

Shiba et al.

[11] Patent Number: 5,921,134

[45] **Date of Patent: *Jul. 13, 1999**

[54] VIBRATORY LINEAR ACTUATOR AND METHOD OF DRIVING THE SAME

[75] Inventors: Takeshi Shiba; Kiyotaka Ootsuka; Masao Tanahashi, all of Hikone, Japan

[73] Assignee: Matsushita Electric Works, Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/776,185

[22] PCT Filed: May 24, 1996

[86] PCT No.: PCT/JP96/01381

§ 371 Date: Jan. 24, 1997

§ 102(e) Date: Jan. 24, 1997

[87] PCT Pub. No.: WO96/37347

PCT Pub. Date: Nov. 28, 1996

Related U.S. Application Data

[30] Foreign Application Priority Data

May 26, 1995 [JP] Japan ..... 7-128526

[51] Int. Cl.[6] ..... B26B 19/28

[52] U.S. Cl. ..... 74/110; 30/43.92; 310/20

[58] Field of Search ..... 74/110; 30/43.9, 30/43.92; 310/15, 20, 17

[56] References Cited

U.S. PATENT DOCUMENTS

| | | | |
|---|---|---|---|
| 3,863,338 | 2/1975 | Wellinger et al. | 30/43.92 |
| 3,962,783 | 6/1976 | Rentema | 30/34.1 |
| 4,583,027 | 4/1986 | Parker et al. | 318/128 |
| 5,159,755 | 11/1992 | Jestadt et al. | 30/43.92 |
| 5,632,087 | 5/1997 | Motahashi et al. | 30/43.92 |
| 5,736,797 | 4/1998 | Motahashi et al. | 310/36 |

FOREIGN PATENT DOCUMENTS

| | | |
|---|---|---|
| 1151307 | 9/1960 | Germany . |
| 1142203 | 1/1963 | Germany . |
| 6420886 | 1/1989 | Japan . |
| 4-36970 | 3/1992 | Japan . |
| 5031265 | 2/1993 | Japan . |

*Primary Examiner*—Charles A. Marmor
*Assistant Examiner*—David Fenstermacher
*Attorney, Agent, or Firm*—Greenblum & Bernstein P.L.C.

[57] ABSTRACT

A vibratory linear actuator employs a reciprocating type motor for reciprocatingly driving several movable components at the same frequency and in opposite phase relations with each other. Both movable components are mechanically connected so as to transmit vibration from one to the other by reversing the direction of the vibration thereof. By this arrangement, the opposite phase relation between both movable components is mechanically insured. As a result, since the opposite phase relation between movable components can be maintained even when an external disturbance is applied thereto, the whole vibration system is stable against external disturbances.

23 Claims, 18 Drawing Sheets

AMPLITUDE POSITION
↑LEFT
CENTER
↓RIGHT
DISPLACEMENT
ACCELERATION
+
OUTPUT OF SENSOR 0
−
SPEED
MOVING DIRECTION
RIGHT
LEFT
WAVEFORM OF DRIVE OUTPUT
RIGHT OUTPUT
t
T
LEFT OUTPUT
WAVEFORM OF DRIVE CURRENT
t1
t1
t1
t1

VIBRATORY LINEAR ACTUATOR AND METHOD OF DRIVING THE SAME

FIELD OF THE INVENTION

The present invention relates to a vibratory linear actuator employing a reciprocating motor which electromagnetically drives a plurality of movable components at the same frequency and at opposite phases with respect to a stationary component.

DESCRIPTION OF THE PRIOR ART

A conventional vibratory linear actuator, for example, German Patent Publication No. 1151307, is known. In this conventional example, a plurality of movable components are supported on a stationary component by spring members. The movable components are electromagnetically vibrated reciprocatingly (i.e., in alternating directions) at the same frequency and at opposite phases so as to attenuate the whole vibration by superposing vibrations of opposite phases to each other.

However, this vibratory linear actuator is basically a spring vibration system, and is not stable against an external disturbance. If an external force is applied to any of the movable components, for example, where a linearly oscillating actuator is used in an electric shaver, the amplitude of the movable components applied with a load fluctuates transiently. This upsets the balance with the other movable components, which produces uncomfortable vibrations to an user.

SUMMARY OF THE INVENTION

The present invention has bees developed in view of the above-described problem of the conventional example. An object of the present invention is therefore to provide a vibratory linear actuator which does not generate uncomfortable vibrations without destroying the balance with the other movable component during the normal drive, even when an external force is applied to any one of the movable components, and a method of driving the same.

In order to achieve the afore-mentioned object, according to the present invention, the movable components adapted to be electromagnetically driven reciprocatingly at the same frequency and at phases opposite to each other are mechanically linked with each other so that the vibration of one movable component can be transmitted to the other movable component with the direction of oscillation being inverted, thus to mechanically insure the opposite phase relation of both movable components. More specifically, when an external force is applied to a movable component and the oscillating state is changed, since the change in the oscillating state is transmitted to the other component in the state where the direction of such change is inverted, the opposite phase relation between movable components is maintained. Thus, the balance of the vibration is secured.

Furthermore, when a whole oscillating system including movable components set in the opposite phase relation is considered, since both phases are equal in the absolute value or in a proportional relation, the center of amplitude of the vibrating system remains unchanged and the whole oscillation is stabilized.

As a mechanism for linking both movable components so as to maintain opposite phase relation to each other, various mechanisms may be considered. For example, both movable components may be liked with each other via a link rotatably supported on a fixed axle.

And it is desirable that the support point of the link and the connection points of the link with respective movable components are positioned on the same line.

It is also desirable that the ratio of respective distances between the link support point and the connection points of respective movable components with the link is nearly equal to the ratio of amplitude amounts of both movable components under the state where no link is attached.

Furthermore, it is desirable that the ratio of the distances between the link support point and the connection points of respective movable components with the link is nearly equal to the inverse mass ratio of both movable components.

It is also desirable that the connection points of the link with respective movable components are constituted by axles and long holes wherein said axles are inserted. Furthermore, it is desirable that the lengthwise edge of said long hole is made the amplitude restricting portion for restricting the amplitude of the movable component within a predetermined amount with the contact of the axle thereto.

In addition, it is also desirable to interpose an auxiliary link between said link and movable component.

In addition, it is also desirable to provide the link with an elastic thin plate section having elasticity.

It is also desirable to provide a link pressing spring elastically urging the link in a certain rotative direction.

Furthermore, the vibratory linear actuator may be so arranged that both movable components having opposite phase relations with each other are respectively provided with rack gears and both rack gears are meshed with a pinion gear rotatably supported on a fixed axle so as to be driven in opposite directions.

In addition, it is also desirable that movable components are swingably supported on fixed portions by spring members. Both movable components have opposite phase relations with each other are connected together by means of a connection spring.

According to the present invention constituted as described above, the vibration system of a vibratory linear actuator can be stabilized against external disturbances, the imbalance of the vibration induced by external disturbances can be early restored to the steady state and thus, the vibration as a whole can be minimized. Furthermore, in the link structure wherein both movable components set in opposite phase relation are connected with each other via a link rotatably supported on a fixed axle, when an external force is applied to any one of both movable components having opposite phase relation, the amplitudes of both movable components are regulated between each other and the occurrence of non-steady vibrations of the movable components can be suppressed.

In addition, in the linear actuator wherein the support point of the link and respective connection points of the link with movable components are positioned in the same line, the amounts of the link moved by both movable components in the steady vibration can be made constant at all times, and no wasteful load is generated.

In addition, in the linear actuator wherein the ratio of respective distances between the link support point and the connection points of the link with respective movable components is nearly equal to the ratio of amplitude amounts of both movable components under the state where no link is attached, there is no change in the movements of movable components due to the existence or non-existence of the link, force is therefore not applied to the link by movable components operating in the steady vibration.

Furthermore, in the linear actuator wherein the ratio of the distances between the link support point and the connection points of the link with respective movable components is nearly equal to the inverse mass ratio of both movable components, the products of amplitude and mass of the movable components moving in the opposite directions in the steady vibration can be made the same so as to cancel the vibrations in the steady vibration.

In the linear actuator wherein the connection points of the link with respective movable components are constituted by axles and long holes wherein said axles are inserted, both movable components operating in an opposite phase relation can be connected with each other via a link in a simple structure. Here, when the lengthwise edge of said long hole is made the amplitude restricting portion for restricting the amplitude of the movable component within a predetermined amount with the contact of the axle thereto, if the amplitude becomes too large, the axle contacts the amplitude restricting portion and thus, the amplitude can be restricted.

Furthermore, in the linear actuator wherein an auxiliary link is interposed between said link and movable component, the connection of the link with the auxiliary link and the connection of the auxiliary link with the movable component may be such as to permit rotation of an axle around a hole, thus eliminating sliding motion at the connection portion and reducing wears.

In the linear actuator wherein the link is provided with an elastic thin plate section having an elasticity, variation in the distance between axles can be absorbed by said elastic thin plate section.

Still further, in the linear actuator wherein a link pressing spring elastically urging the link in a certain rotative direction is provided, the link can be pressed in a certain rotative direction at all times, and thus, the rattling of the connection portion can be prevented.

In the linear actuator wherein both movable components in opposite phase relations with each other are respectively provided with rack gears and both rack gears are meshed with a pinion gear rotatably supported on a fixed axle so as to be driven in opposite directions, both movable components having opposite phase relations with each other can be connected with a simple structure of a pinion and racks, and because of the structure of the pinion and racks, sliding motions are eliminated to reduce wears.

Furthermore, by swingably supporting the movable component with spring on a fixed portion and connecting together both movable components operating in an opposite phase relation with a connection spring, the occurrence of vibration as a whole can be suppressed.

BEST MODE FOR CARRYING OUT THE INVENTION

Figure 1:
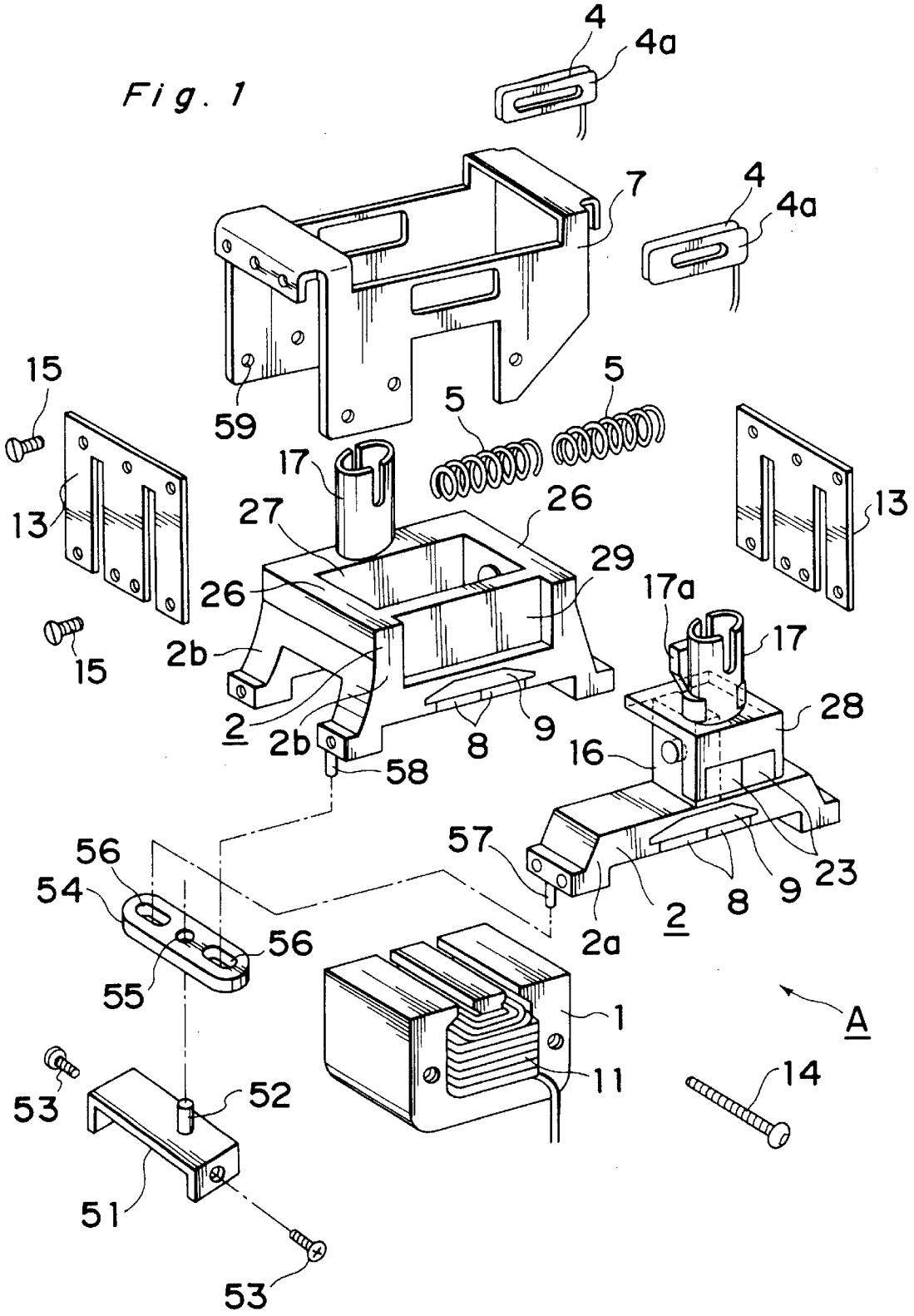
FIG. 1 is an exploded perspective view showing an embodiment of the present invention.
Figure 2:
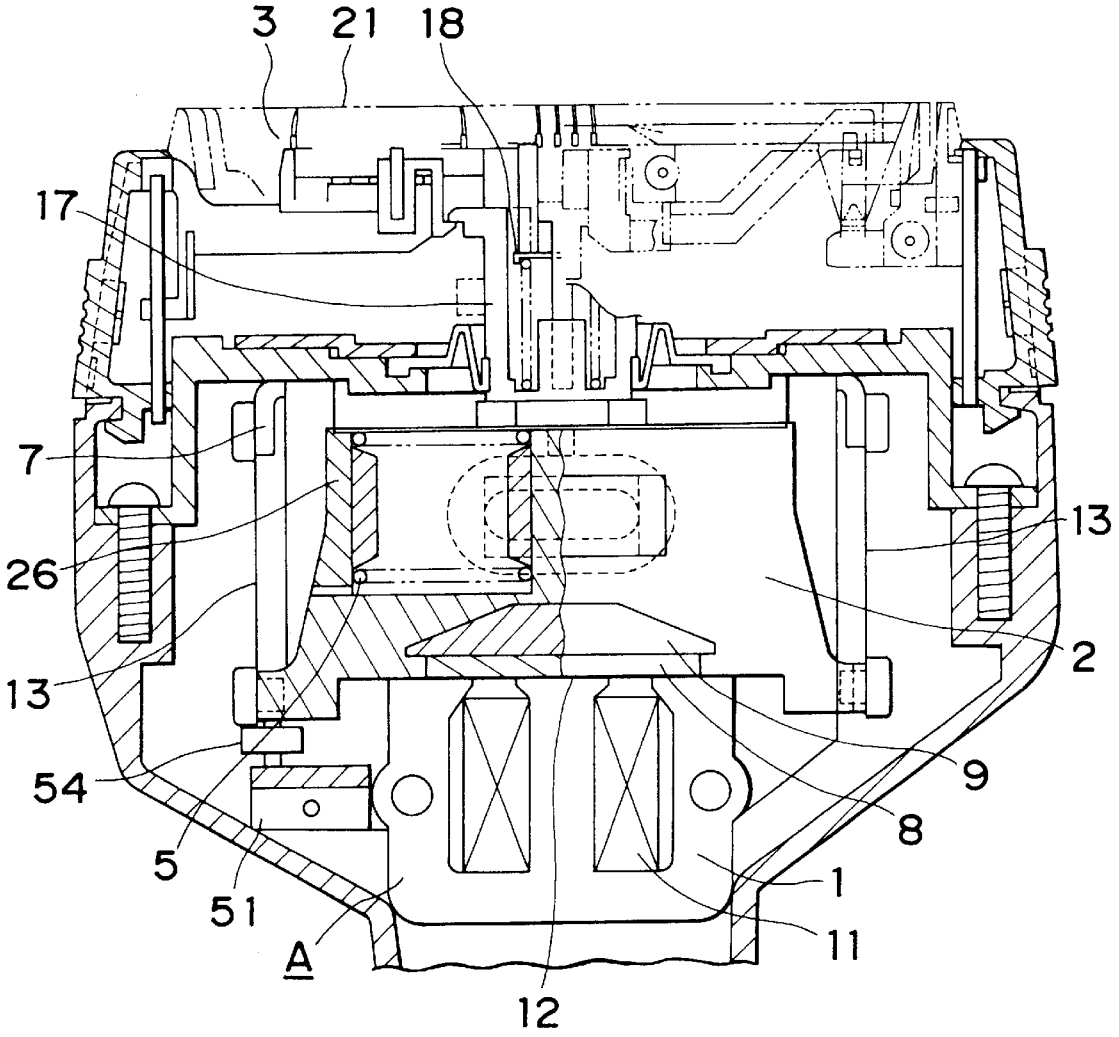
FIG. 2 is a front sectional view of the essential portion of a reciprocating type electric shaver employing the linear-driven reciprocating motor shown in FIG. 1 as the drive section thereof.
Figure 3:
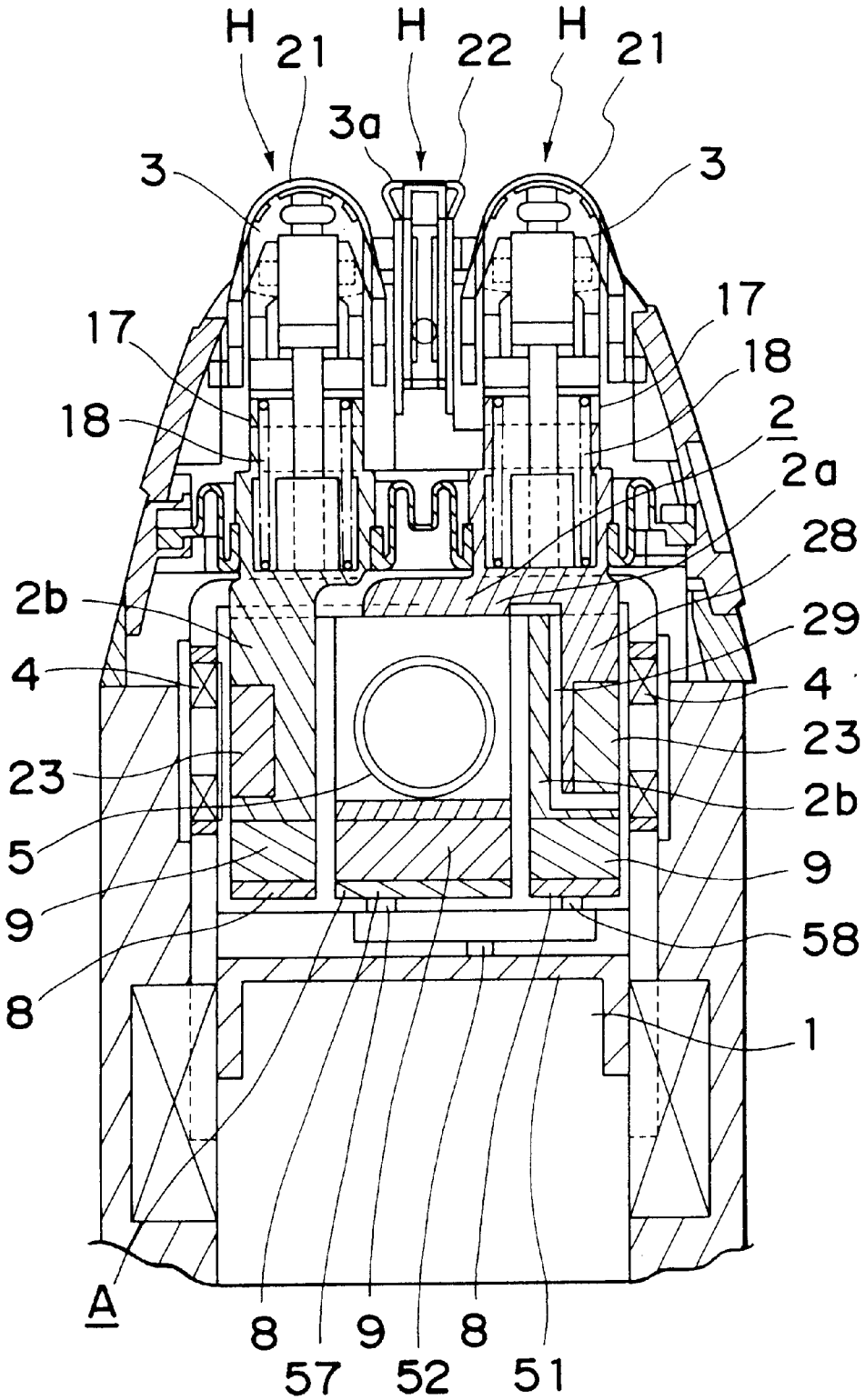
FIG. 3 is a side sectional view of the essential portion of the reciprocating electric shaver shown in FIG. 2.
Figure 4A:
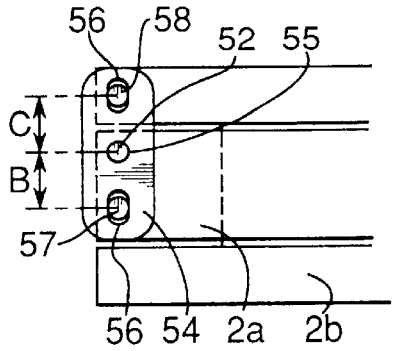
FIGS. 4A to 4E are explanatory drawings showing the operation sequence of a link of said electric shaver.
Figure 4B:
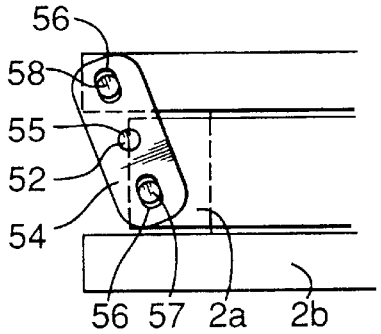
Figure 4C:
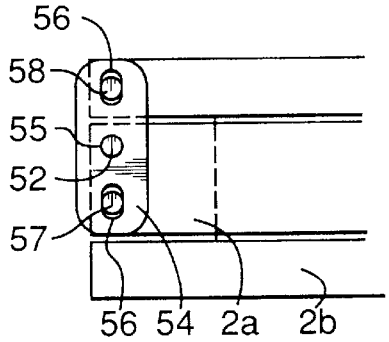
Figure 4D:
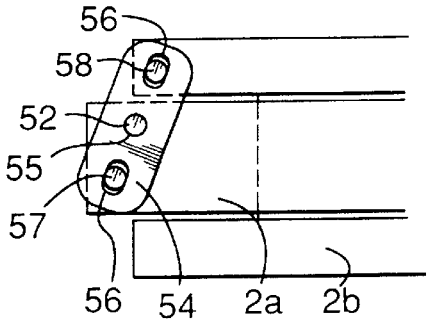
Figure 4E:
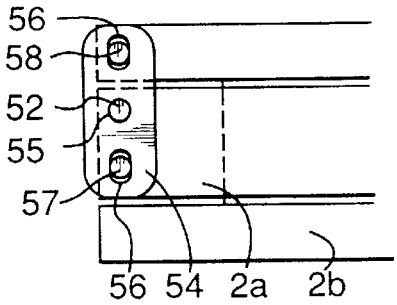
Figure 5A:
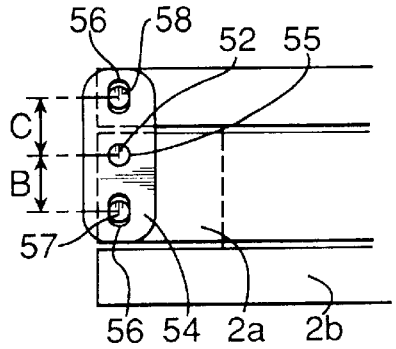
FIGS. 5A to 5E are explanatory drawings showing the operation sequence of another embodiment of a link in said electric shaver.
Figure 5B:
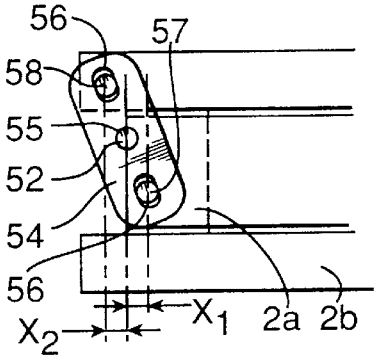
Figure 5C:
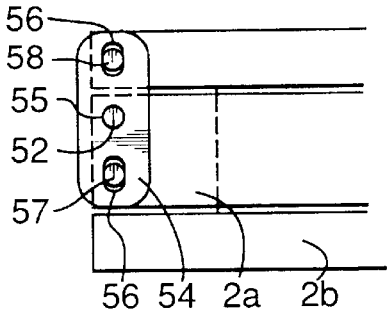
Figure 5D:
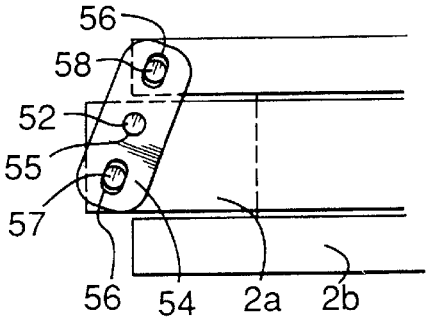
Figure 5E:
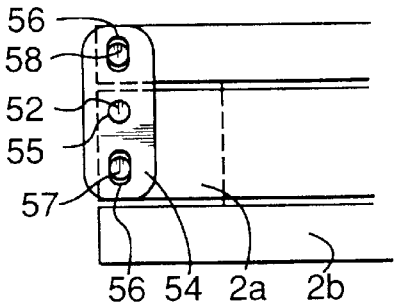

Hereinbelow, the present invention is described based on the embodiments shown in the accompanying drawings. FIG. 1 is an exploded perspective view of a linear-drive reciprocating type motor A. FIGS. 2 and 3 are respectively front and side sectional views showing the essential portion of a reciprocating electric shaver using the linear-drive reciprocating type motor A as the drive section thereof. In these figures, reference numeral 2 denotes a movable component which is provided with permanent magnets 8 and yokes 9 (back yokes). Each yoke 9 is made of a magnetic material and the permanent magnets 8 are bonded thereto. Reference numeral 1 denotes a stationary electromagnet composed of a sintered body of a magnetic material or a lamination of steel plate of magnetic material and a winding 11 provided thereon. The stationary electromagnet confronts the permanent magnets 8 on the movable component 2 with a gap 12 disposed therebetween. Reference numeral 13 denotes plate-shaped spring members for ensuring said gap 12. The upper end portion of each spring body 13 is fastened to the chassis 7 by screws 15 while the lower and portion thereof is fastened to a movable component 2 by means of screws 15. Thus, the chassis 7 and movable components 2 are connected together through said spring members 13. The electromagnet (stationary component 1) is fastened to the chassis 7 by screw members 14. By alternating the direction of flow of electric current in the electromagnet, a reciprocating type motor A, i.e., a so-called linear motor wherein the permanent magnet 8 on the movable component 2 is moved in directions opposite to each other, is constituted.

The movable component 2 is provided in plural pieces. In the embodiment shown in the attached drawings, two pieces of movable components 2*a* and 2*b* are provided. An upper face portion of the central movable component 2*a* is formed with a protruding portion which acts as spring support portions 16 on both side faces thereof. From the upper portion of said protruding portion, an inverted L-shaped protruding piece 29 is provided. On the vertical side face of said protruding piece 28, a sensor magnet 23 is installed (on the chassis, at a position confronting the sensor magnet 23 provided on the movable component 2, a detection sensor 4*a* detects displacement in the moving direction, speed, acceleration of the movable component 2). Furthermore, from the upper face of said protruding portion, a drive component 17 is protrudingly provided. The protruding portion of the central movable component 2*a* is inserted into a rectangular opening 27 enclosed by a pair of side movable components 2*b* and a pair of connection members 26. The vertical side face of L-shaped protruding piece 28 with the sensor magnet 23 provided thereon is positioned within the recess 29 defined in one side movable component 2*b* for movement within said recess 29. Both connection members 26 also serve as the spring support members. Between these connection members 26 serving as the spring support members and the spring support portions 16 on the central movable component 2*a,* connection springs 5, each serving a natural frequency setting, are interposed.

On the drive component 17, a movable blade 3 is installed for movement up and down. The movable blade 3 is pushed upwards elastically by a push-up spring 18 so as to elastically contact a net blade 21. Furthermore, reference numeral 22 denotes a slit blade and reference numeral 3*a* is a movable blade for said slit blade, which is driven by a drive component 17*a* for the slit blade provided on one drive component 17. In the present embodiment, there are two blade heads H, each composed of a combination of a movable blade 3 and a net blade 21. A third blade head H is composed of the slit blade 22 and the net blade 3*a* for the slit blade. Further in the present embodiment, the polarities of the permanent magnets of movable components corresponding to respective blade heads H are different to each other. As a result, directions of reciprocating motion of respective movable components become opposite to each other to alleviate vibrations.

Figure 18:
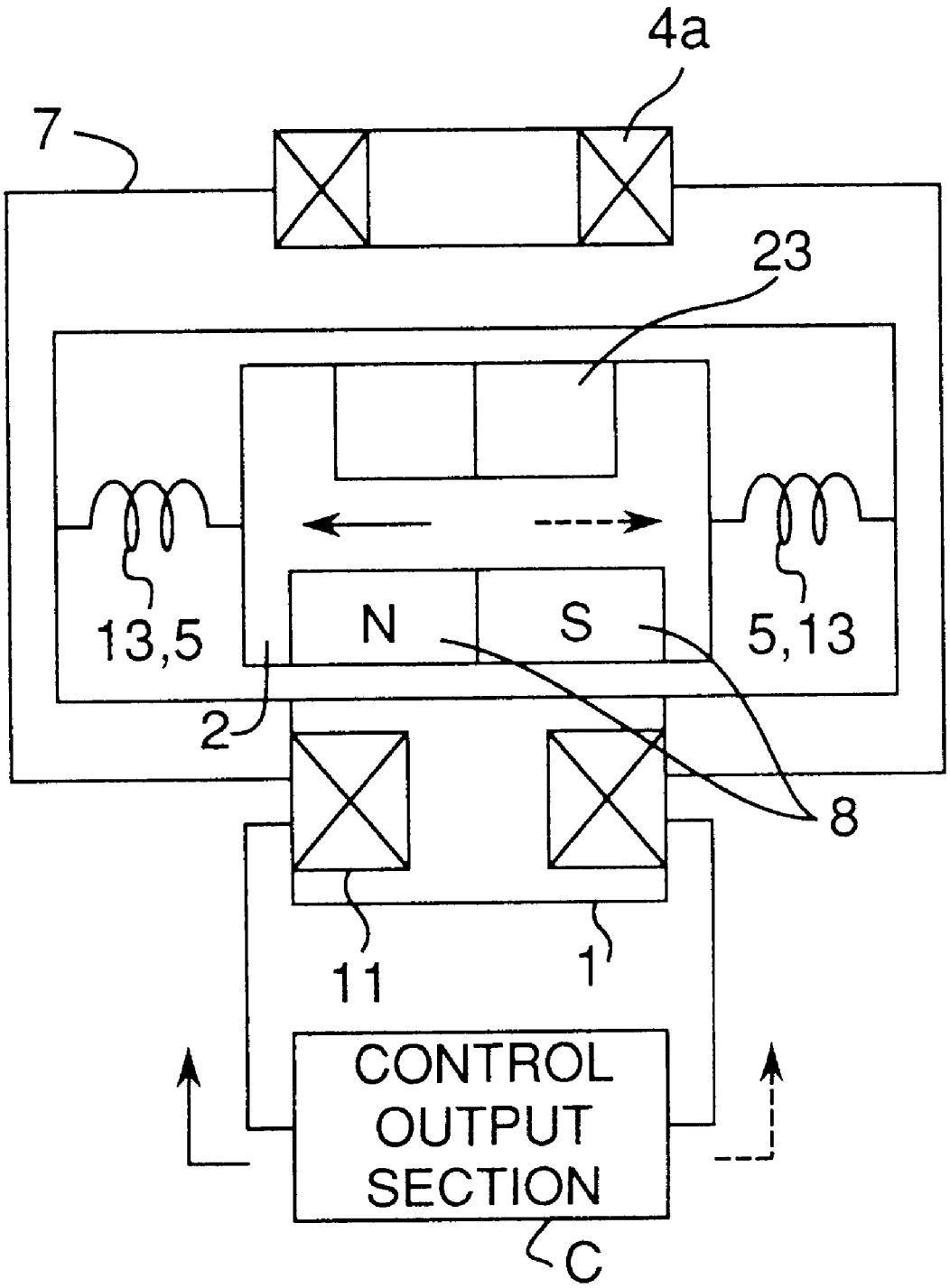
FIG. 18 is an explanatory drawing showing the drive system of the motor A according to the present invention.

One example of the driving method of the reciprocating motor A is described with reference to FIGS. 18 and 19. The permanent magnet 8 provided on the movable component 2 confronts the stationary component 1 in the up-and-down direction via a predetermined gap, and is magnetized in the reciprocating direction of movable components. As shown in FIG. 18, in accordance with the direction of the current fed through the coil 11 of the stationary component 1, the movable component 2 moves right and left while deflecting springs 5 and 13. By switching the direction of the current fed to the coil 11 at a suitable timing, the movable components move reciprocately.

The arrangement of magnetic poles of the permanent magnet 8 on the movable component 2*a* are opposite to the arrangement of magnetic poles of the permanent magnet 8 on the movable component 2*b*. Both movable components 2*a* and 2*b* thus move reciprocatingly 180° different in phase with each other. At this time, spring members 5, 5 are compressed or expanded. The spring system shown in FIG. 18 is composed of sheet springs 13 and spring members 5 (strictly, spring constant components by magnetic pull force are further added).

When vibrating a vibration system having such a spring system in order to create a stable vibration while reducing the vibration energy, it is desirable to vibrate the system in synchronization with the natural frequency of the vibration system. In other words, to place the vibration system in resonance, a sensing magnet 23 having magnetic poles arranged in the reciprocating direction of the movable component 2 are installed on the movable component 2. Sensors 4*a* each composed of a sensing coil, are provided on the mounting stands provided on frame 7 so that the control output section C can control the current fed in coil 11 based on the current (voltage) induced in the sensors 4*a* along with the vibration of the movable components 2.

Figure 19:
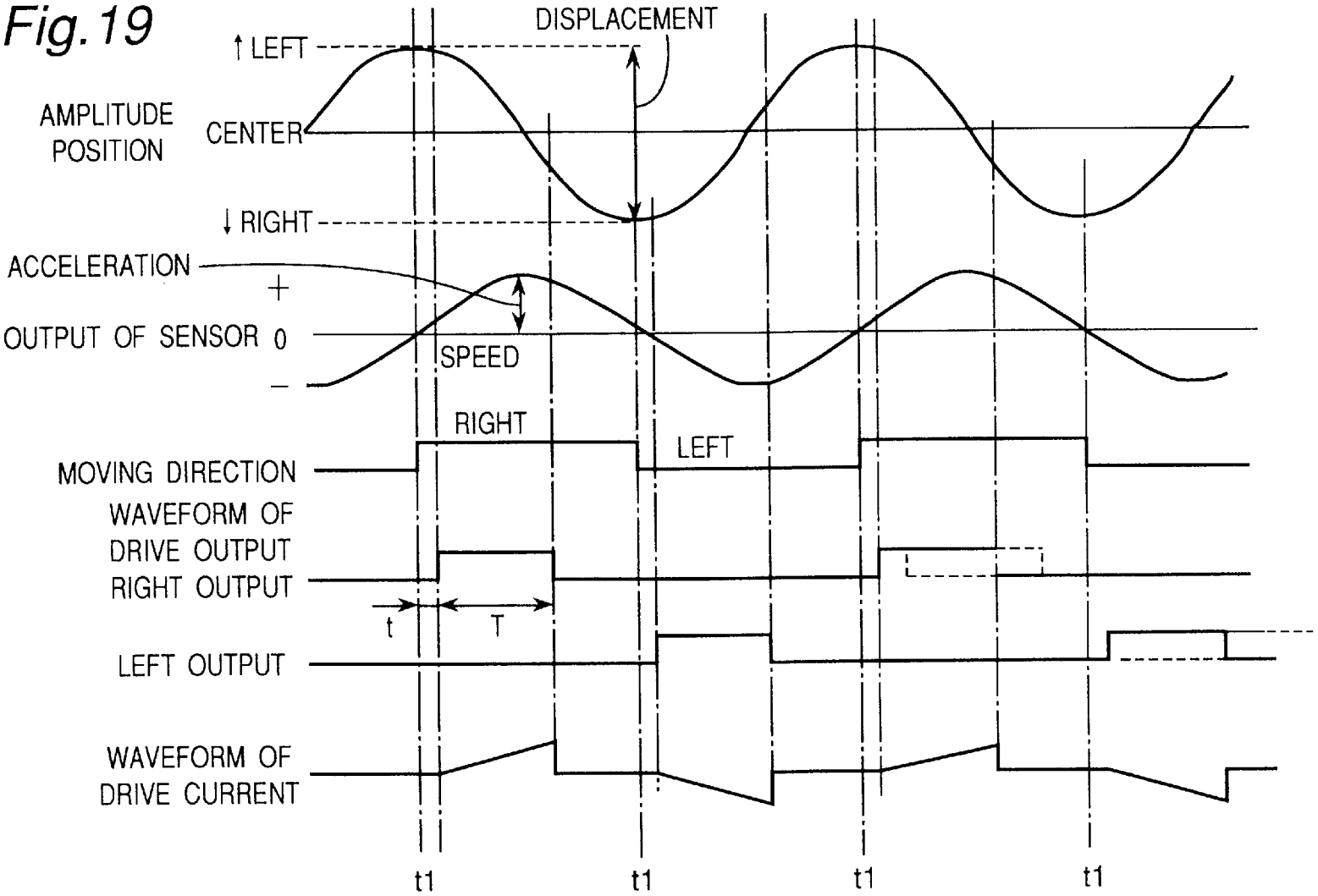
FIG. 19 is a waveform diagram of a signal used for driving motor A.

More specifically, the voltage of the current induced in the sensor 4*a*, as shown in FIG. 19, changes in accordance with the amplitude and position of a movable component, the speed of vibration, and the direction of vibration. Namely, when the movable component 2 reaches one end of the amplitude of the reciprocating motion, the notion of the magnet 23 stops such that the change in magnetic flux becomes zero, resulting in no output of the sensor 4*a*. When the movable component c reaches the central position of the amplitude, the speed of the movable component c maximizes such the that output voltage of the sensor 4*a* also maximizes. As a result, by detecting the maximum voltage, the maximum speed of the movable component 2 can be detected. The zero point can be detected as a point of reversion of the direction of movement (dead point reaching point). From the polarity of the output of the sensor 4*a,* the moving direction of the movable component 2 can be detected.

While the output voltage of sensor 4*a* changes in a sinusoidal curve, after amplifying with an amplifying circuit (not shown), this output voltage is converted into a digital value by means of an A/D conversion circuit (not shown). The voltage after lapse of a predetermined time (for example,t) from zero output voltage is detected. The maximum speed of the movable component 2 at the middle point of amplitude can be detected by detecting the maximum voltage from zero output voltage to zero output voltage. The moving direction reversing time point can be detected from the timing when output voltage becomes zero. Furthermore, the current direction being changed by the direction of the reciprocating motion of the movable component 2 (magnet 23), and the current stroke of the reciprocating motion of the movable component 2 can be detected from the polarity of the output voltage.

When the control output section C detects from the detected speed of the movable component 2, for example, a decrease in amplitude due to an increase of the loading, the control output section C maintains the amplitude at the required value by increasing the amount of drive current (in the illustrated example, current applying time and maximum current value). It is to be noted that in the illustrated example, control of the drive current amount is made by PWM control and the current amount is arranged to output PWM of a pulse width memorized in advance with respect to the detected speed. It is to be noted that since speed, displacement and acceleration are correlated, displacement or acceleration may be detected instead of speed.

In addition, by feeding current in the direction corresponding to the detected moving direction, the occurrence of a braking state by the driving current can be prevented. Furthermore, by feeding current at a predetermined timing t from the detected moving direction reversing time point, the retired currant amount for the drive of the movable component 2 is suppressed by utilizing the motion of the spring system. In other words, if current of the opposite direction drive is applied to the coil 11 before the moving direction reversing time point, the vibration is braked. If the current in the moving direction is applied to the coil 11 after the movable component has passed the central point of the amplitude, because the driving force by the repulsion force of the spring system compressed by the vibration of the movable component 2 has already become weak, the synergistic force of the drive by the electro-magnetic force and the drive force by the spring system can not be obtained. Therefore, the timing of starting current supply to the coil 11 is set within the time period from the moving direction reversing time point to the amplitude mid-point reaching time point. The time point of reaching the amplitude mid-point can be detected as the time point whereat the output of said sensor 4*a* maximizes. The time t here may be a value adjustable in accordance with the detected speed or acceleration of the movable component 2.

It is to be noted that while the drive method for the motor A is not limited to the above-described example, the same drive method is employed also in the following embodiments.

The link mechanism will now be described. A link 54 has a central hole 55 defined in a central portion thereof, and, long holes 56 defined in both end portions so as to extend parallel in the lengthwise direction of the link 54. The central hole 55 of the link 54 is rotatably supported on an axle 52 fastened to an axle bass stand 51. The axle base stand 51 is fastened to the fastening holes 59 of the chassis 7 by screws 53 so as to integrate the chassis 7 and the axle base stand 51. An axle 57 is vertically provided under the central movable component 2*a,* and an axle 58 is vertically provided under the side movable components 2*b,* with those axles 57 and 58 inserted respectively into long holes 56 in both ends of the link 54. By this arrangement, the central movable component 2*a* and both side movable components 2*b* positioned in opposite phase relation are connected to each other via the link 54.

FIG. 4 shows the operation of the link 54. Namely, the link 54 operates in the order as shown sequentially in FIGS. 4A to 4E. The link 54 is rotatable only about the axle 52. When any one of the central movable component 2*a* of side movable components 2*b* move, the link 54 rotates around the axle 52 and moves the other movable component in the opposite direction. In other words, even when a load is applied, the difference in amplitude does not occur between both movable components 2*a* and 2*b*. Thus the mode wherein both movable components move in the same direction can be suppressed, preventing uncomfortable vibration. In this case, by the arrangement that axles 57 and 58 slide on the inner face of the long holes 56, the changes in the distance between axles 57 and 58 can be absorbed.

In the embodiment shown in FIG. 4, the axle 52 is positioned in the middle point of axles 57 and 58. Namely, assuming the length from axle 52 to axle 57 as B and that from the axle 52 to axle 58 as C, B is equal to C. By making B=C in this manner, the amplitudes of vibration is equal between both movable components 2*a* and 2*b*.

Furthermore, FIG. 5 shows an example wherein the central hole 55 is positioned close to one side (on the side of movable component 2*b*). In this embodiment, the link 54 operates in the order as shown sequentially in FIGS. 5A to 5E. For this reason, assuming the length from axle 52 to axle 57 as B and the length from axle 52 to axle 58 as C, B is greater than C, and the amplitude $x_1$ of both side movable component 2*b* and the amplitude $x_2$ of the central movable component 2*a* are not equal. Rather, the ratio of both amplitudes is equal to the ratio of intra-axle distances. Namely, $x_1:x_2=B:C$.

It is desirable to equalize the amplitude ratio of movable components 2*a,* 2*b* and the intra-axle distance ratio of axle 52 to axles 57 and 58 (namely, B:C) in the state without the link 54. This is because the steady vibration is not changed by the load of the link 54, and the lack of force applied to the engagement portions of axles 57 and 58 with the long holes 58 reduces wear.

Furthermore, the mass ratio of the central movable component 2*a* and both-side movable component 2*b* which are in the opposite phase relation may be made equal to the inverse ratio of intra-axle distances between axle 52 and axles 57, 58 (namely, B:C). This is because the products of mass and amplitude i.e., M·A) of respective movable components 2 in opposite phase relation are equal to each other. As a result, the vibrations of respective movable components in the steady vibration cancel each other, contributing effectively to reduction of vibrations.

In addition, it is desirable that three holes of the central hole 55, and long holes 56 on both ends are positioned on the same line. By positioning three holes of the central hole 55 of the link 54 and long hole 56 on both ends on the same line as described above, the amount of the link 54 moved by one movable component 2 in the steady vibration and the amount of the link 54 moved by the other movable component 2 are equal at all times. As a result, no force other than a rotating force acts on the central hole 55 of the link 54.

Furthermore, it is desirable to set the intra-axle distances between axle 52 and axles 57, 58 (B, C) to be more than two times as large as the amplitude of the movable component 2. By taking the intra-axle distances between axle 52 and axles 57, 58 to be more than two times the amplitude of the movable component 2 as described above, the fluctuation amount in the intra-axle distance due to the amplitude of the movable component 2 is reduced. This reduces the slide amount of the long holes 56 of the link 54 relative to axles 57, 58 which also reduces loads and noise.

Figure 6:
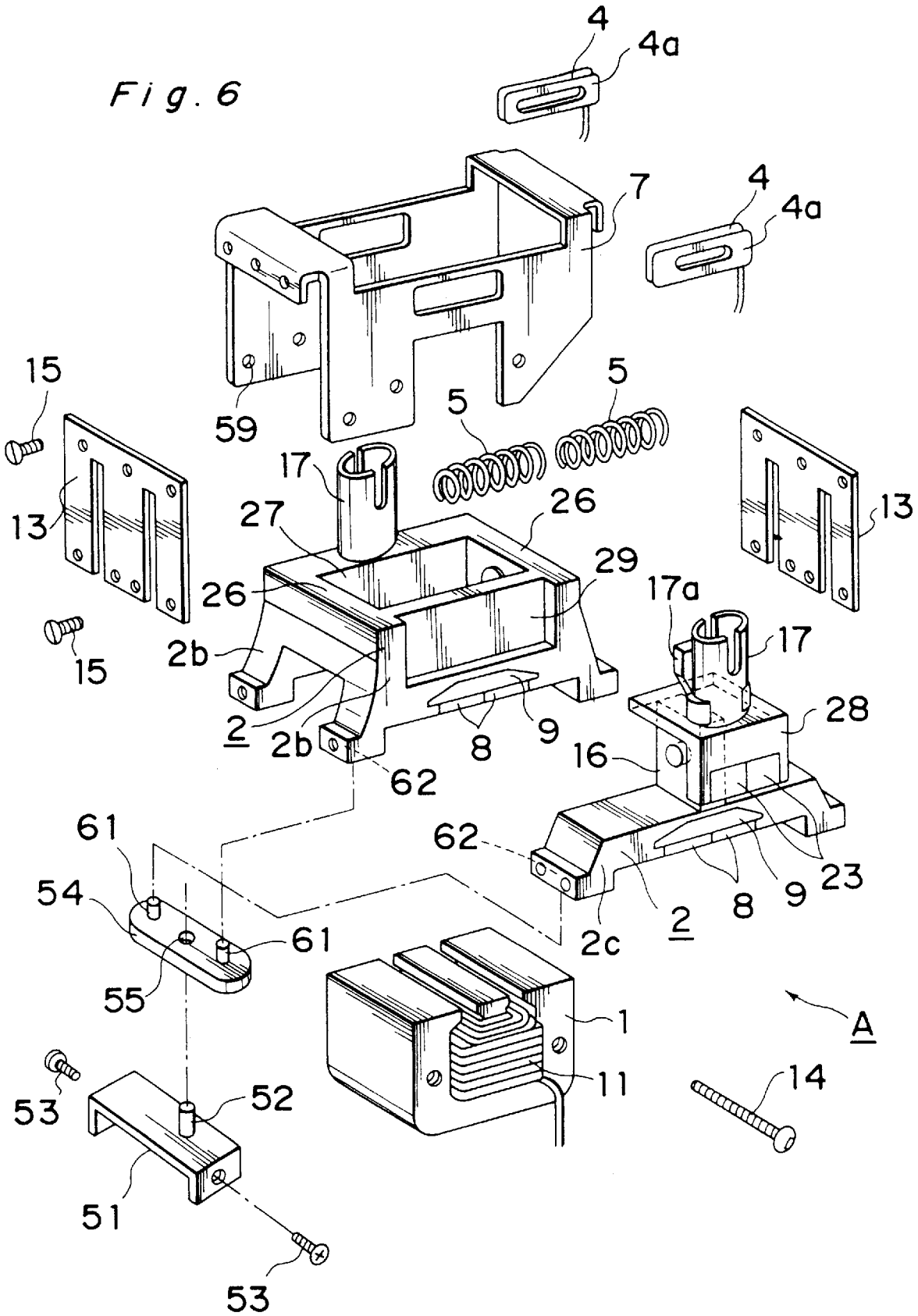
FIG. 6 is an exploded perspective view of another embodiment of the present invention.

In the embodiment shown in FIG. 1, the link 54 is provided only with holes and axles 57, 58 are provided on the movable components 2. Since the transmission of force is conducted on the same plane, the motion becomes smooth, which reduces load and noise. However, it is also possible to provide, as shown in FIG. 6, axles 61 on both ends in the lengthwise direction of the link 54 and holes 62 respectively on the movable components 2, these are positioned in an opposite phase relation with each other for insertion of said axles 61 therein and connection with the link 54.

Figures 7A, 7B:
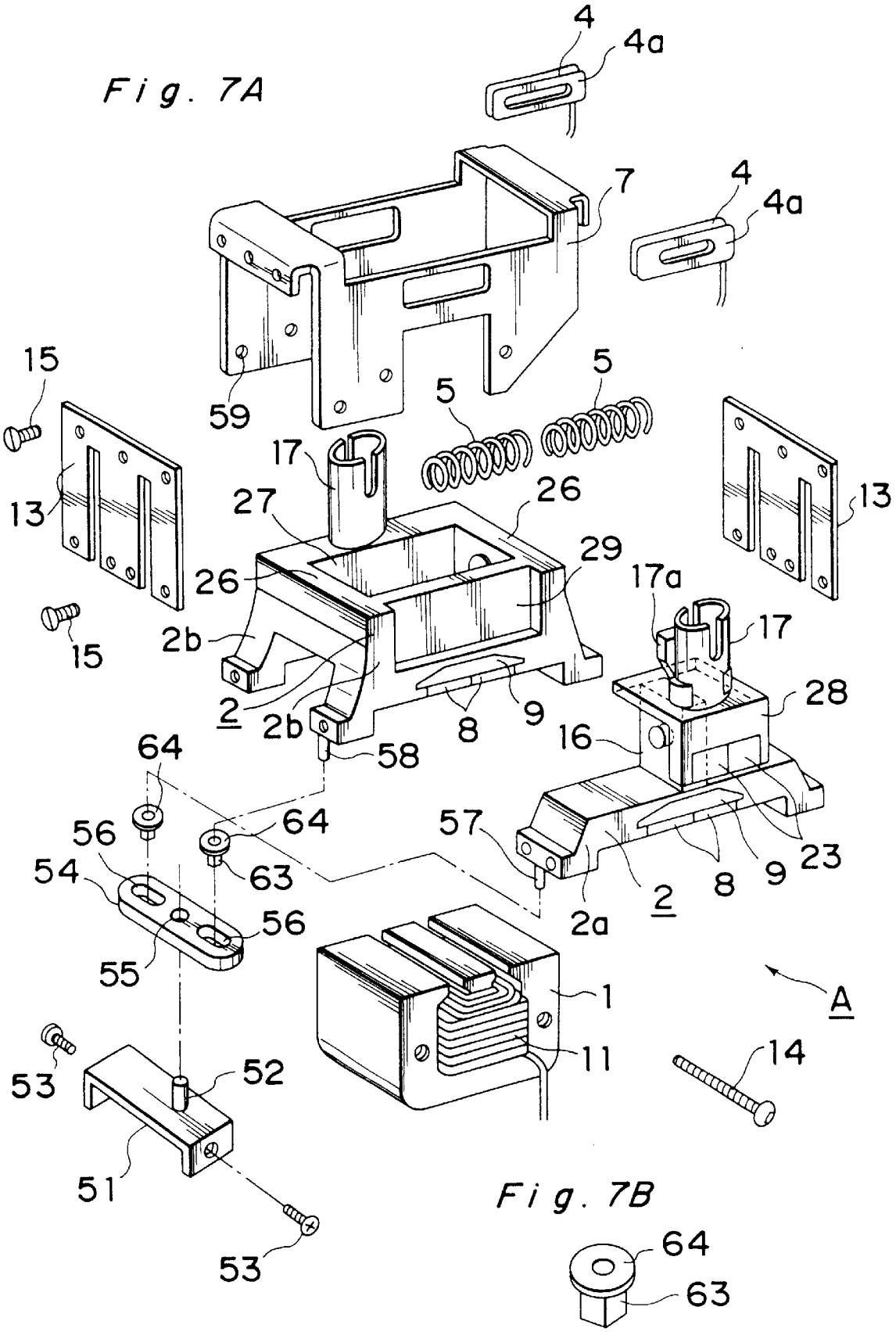
FIG. 7A is an exploded perspective view of still another embodiment of the present invention and FIG. 7B is a perspective view of another embodiment of the roller.

FIG. 7A shows another embodiment of the present invention. In this embodiment, rollers 63 are provided between axles 57, 59 and long holes 56. More specifically, rollers 63 are rotatably inserted on axles 57, 58 and long holes 56. By doing so, sliding between axles 57, 58 and long holes 56 is converted into rolling to reduce load. The roller 63 is provided with a flange 64 to prevent the roller from getting out of the long hole 56. The external shape of the roller 63 may be in a rectangular shape as shown in FIG. 7B.

Figure 8:
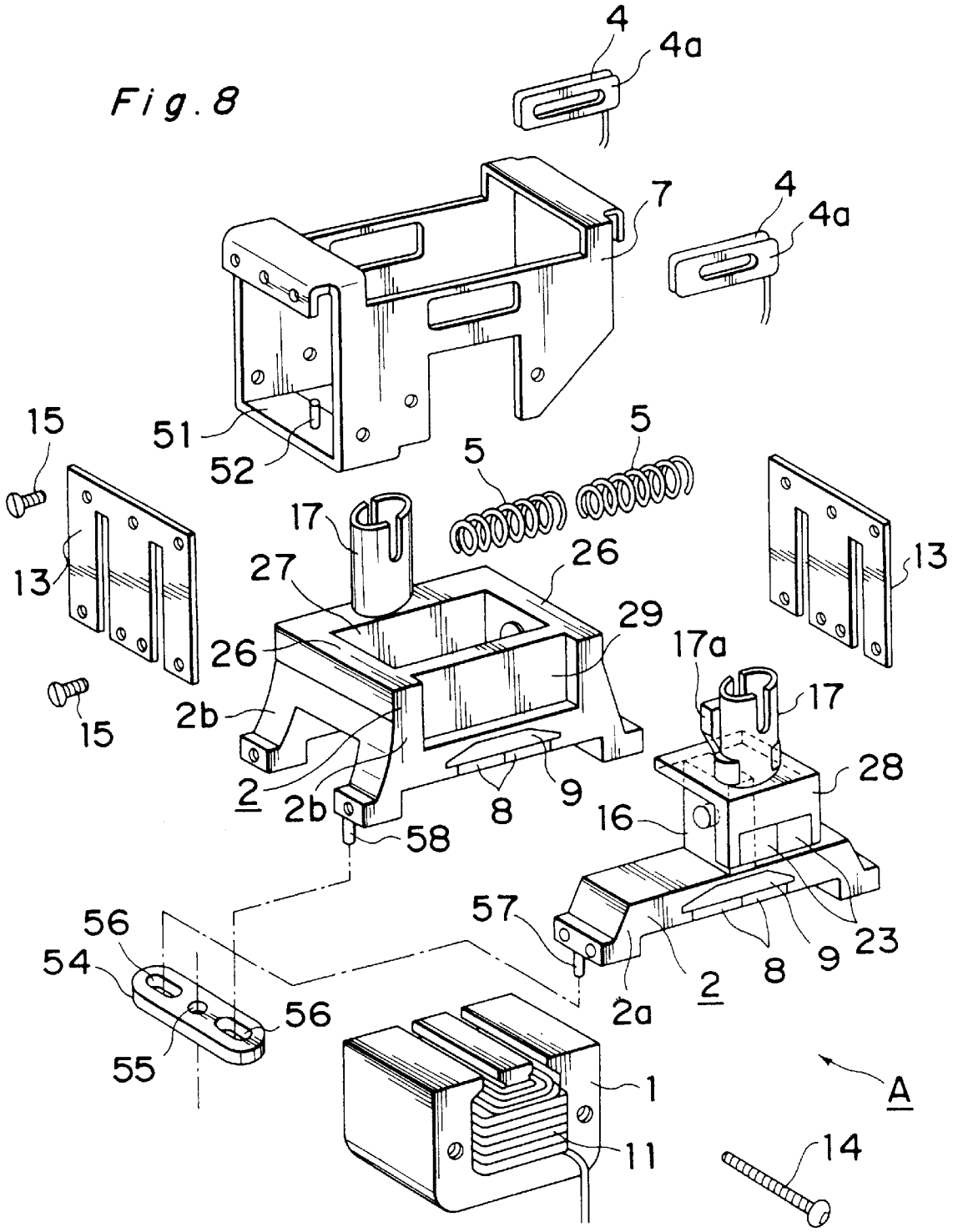
FIG. 8 is an exploded perspective view of still another embodiment of the present invention.

FIG. 8 shows still another embodiment of the present invention. In this embodiment, an axle base stand 51 is integrated with the chassis 7. The axle 52 is directly fastened to a part of the chassis 7 constituting the axle base stand 51, thus reducing the number of parts.

Figure 9:
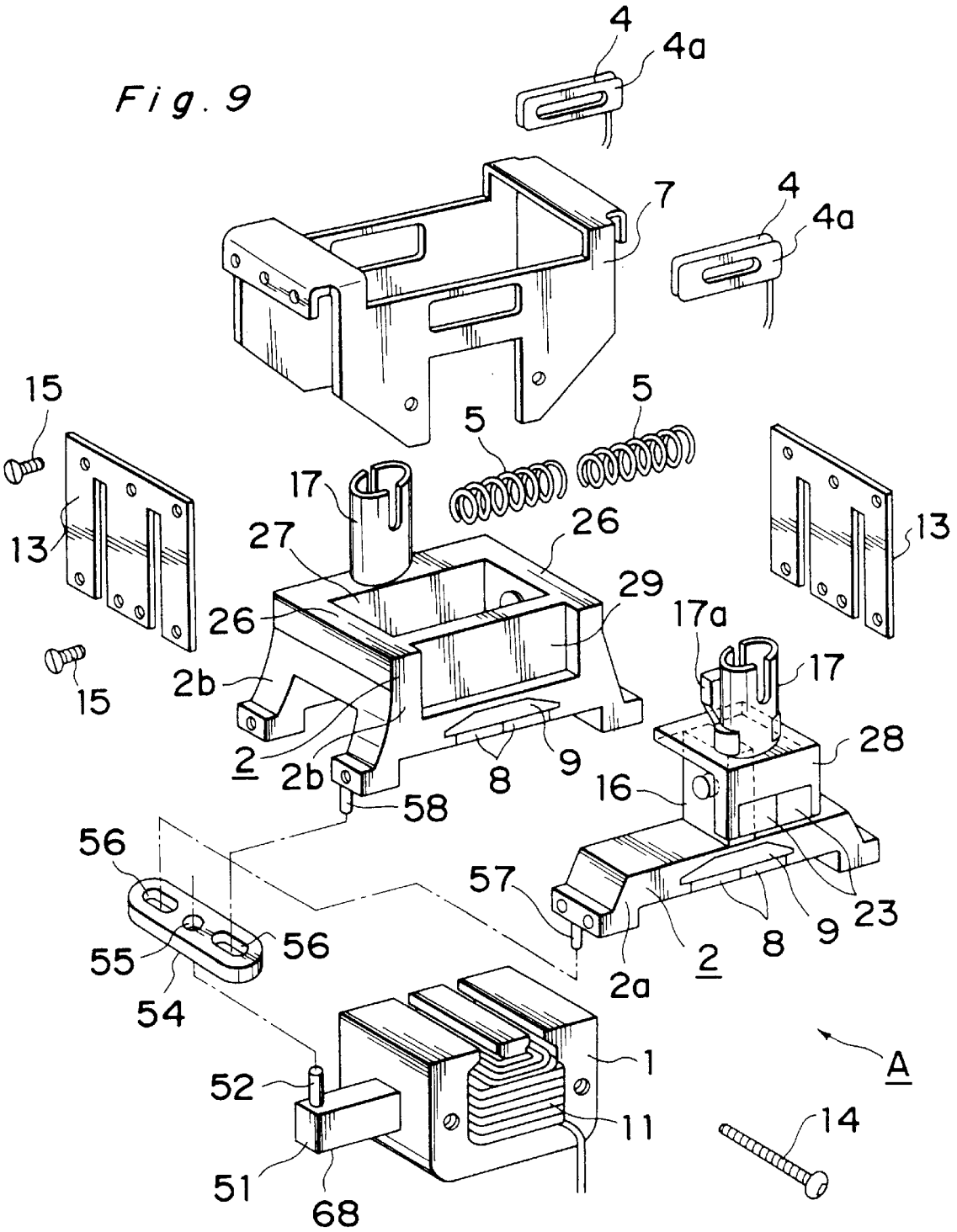
FIG. 9 is an exploded perspective view of still another embodiment of the present invention.

FIG. 9 shows still another embodiment of the present invention. In this embodiment, a protruding piece 68 provided with an axle 52 protrudes integrally from the stationary component 1. By this protruding piece 68, the axle base stand 51 is constituted.

Figure 10A:
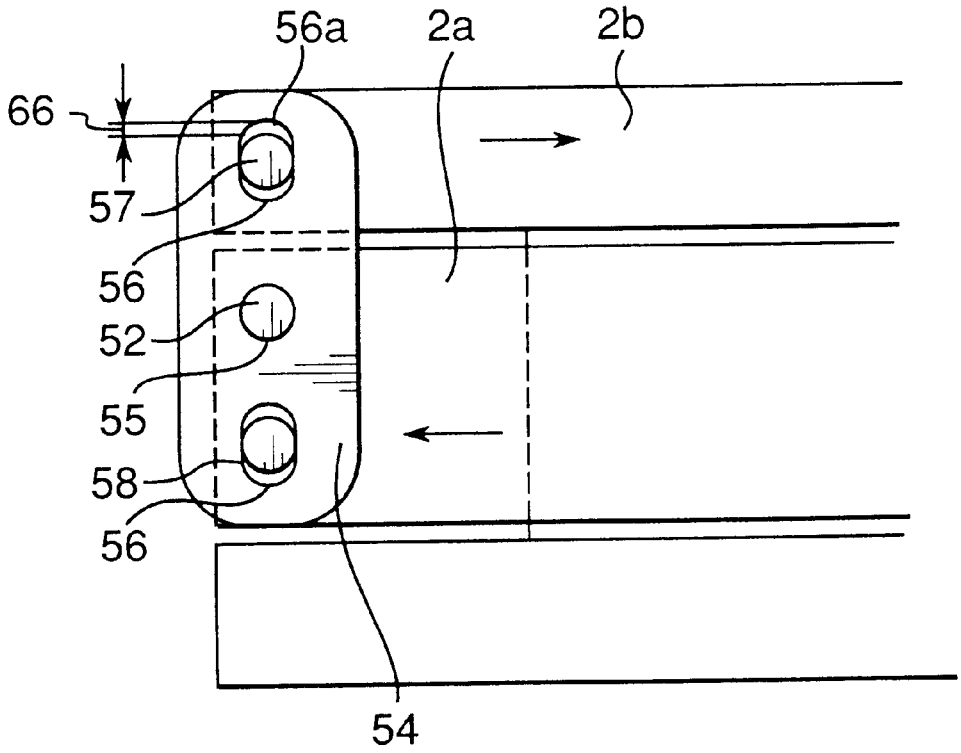
FIGS. 10A and 10B are explanatory drawings showing an example restricting the amplitude by the link.
Figure 10B:
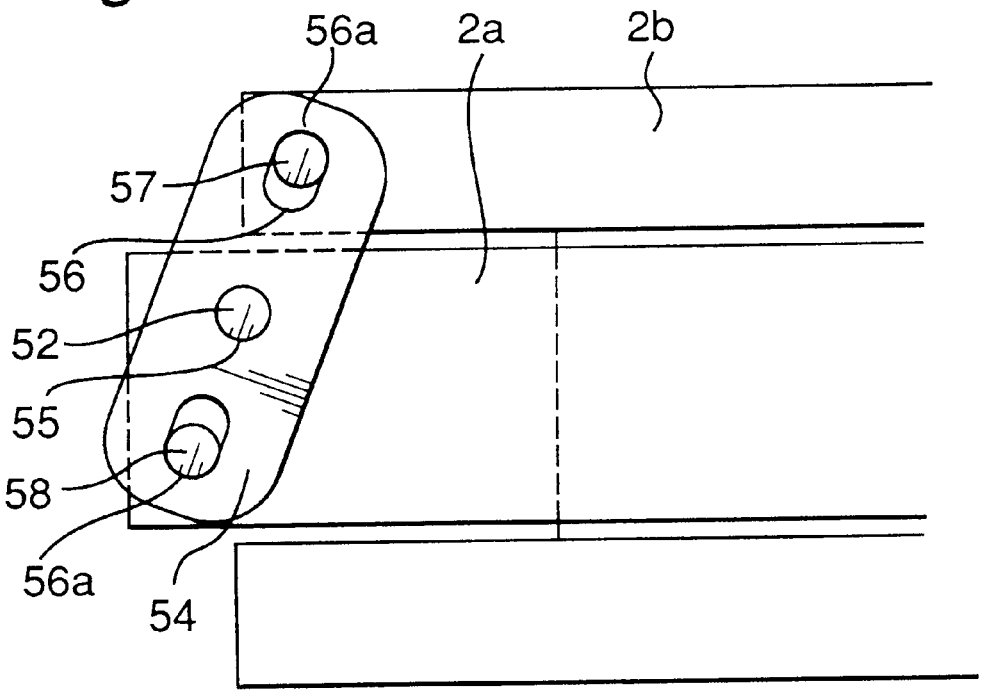

FIG. 10 shows an embodiment showing an example of restricting the amplitude by means of the link 54. More specifically, in an electric motor of this kind, because the movable component 2 is only hung by spring members 13, the amplitude can not be restricted. When the amplitude becomes too large, spring member 13 or connection spring 5 may break. In order to prevent this failure, the lengthwise edge of the long hole 56 has an amplitude restriction section 56*a* for holding the amplitude of the movable component 2 within a predetermined limit through contact of axle thereon. Therefore, the size of long hole 56 on the link 54 is set so that the gap amount 66 between axles 57, 58 and the amplitude restriction portion 56*a*, i.e., the lengthwise edge of the long hole 56, becomes an appropriate amount. By this arrangement, when the amplitude becomes too large, axles 57, 59 come in contact with the amplitude restriction portion 56*a,* i.e., the lengthwise edge of the long holes 56 of the link 54 as shown in FIG. 10(b, thus) to limit the amplitude.

Figure 11:
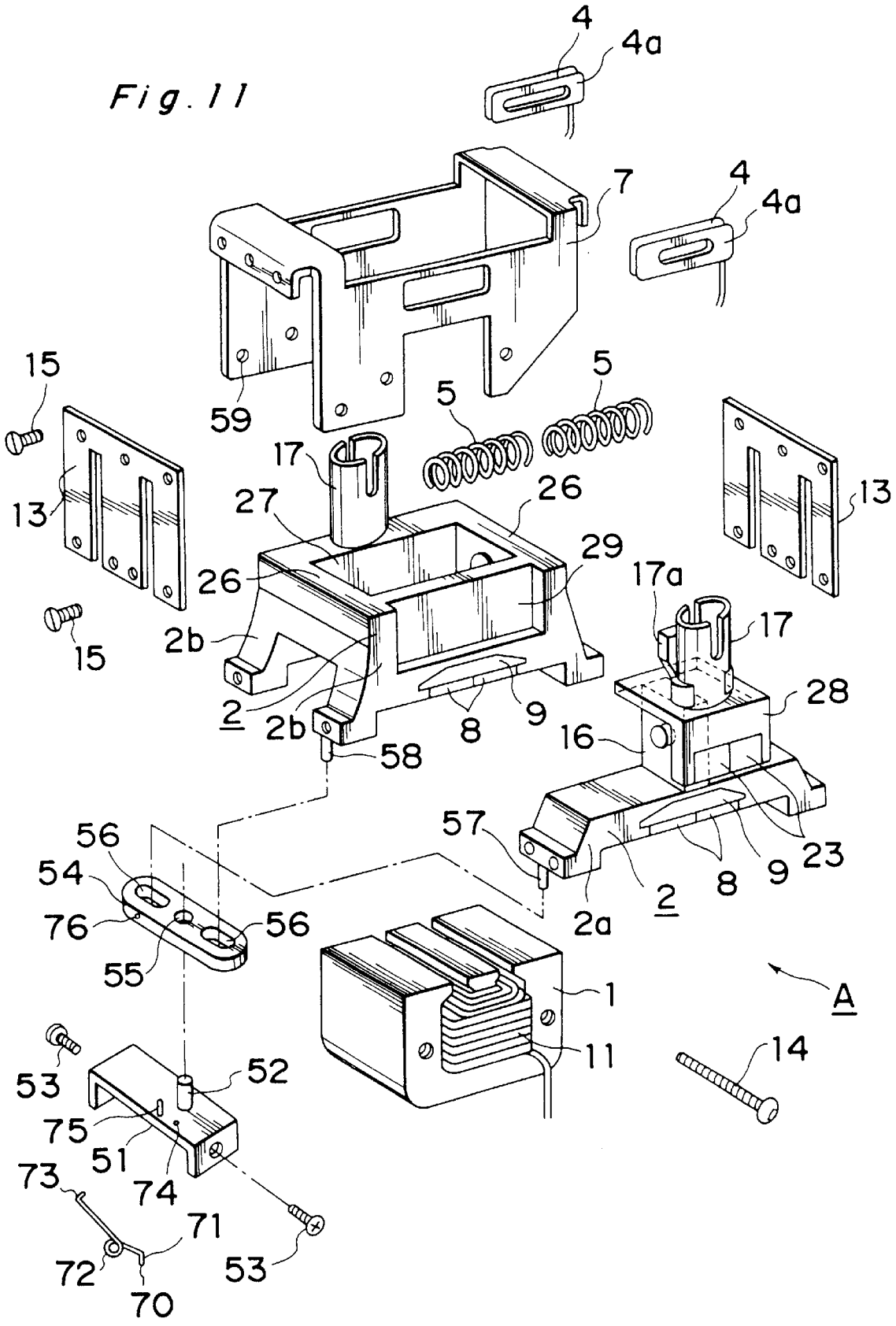
FIG. 11 is an exploded perspective view of still another embodiment of the present invention.

FIG. 11 shows still another embodiment of the present invention. In this embodiment, to reduce the noise caused by rattling in the engagement portions between axles 57, 58 and the long holes 56, a link pressing spring 70 is provided. In the support hole portion 72 defined in the central portion of the link pressing spring 70, a support point axle 75 provided on the axle base stand 51 is inserted. The fastening axle portion 71 on one end portion of the link pressing spring 70 is put into the fastening hole 74 on the axle base stand 51. The installation axle portion 73 on the other and of the link pressing spring 70 is put into the installation hole 76 provided on the side face of the link 54. By this arrangement, the link pressing spring 70 presses the link 54 in a certain rotation at all times, such that the rattling between axles 57, 58 and the link 54 is eliminated.

Figure 12:
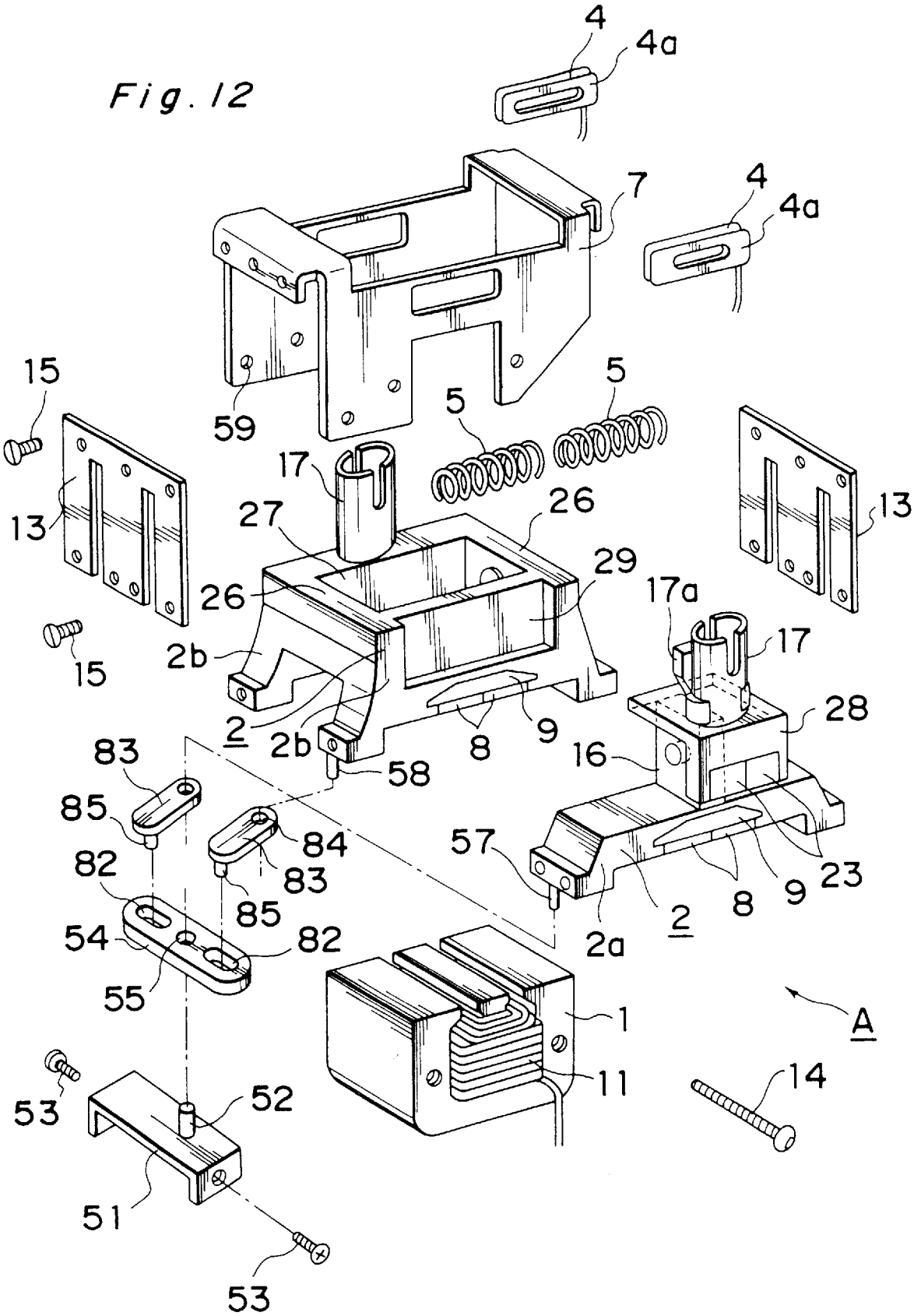
FIG. 12 is an exploded perspective view of still another embodiment of the present invention.

FIG. 12 shows still another embodiment of the present invention. In this embodiment, auxiliary links 83 are interposed between the link 54 and the movable components 2. More specifically, axles 57, 58 are rotatably inserted into holes 84 provided on one end portions of the auxiliary links 83 and the axles 85 provided an the other end portions of the auxiliary links 83 are rotatably inserted into the holes 82 provided on the link 54. In addition, the central hole 55 of the link 54 is rotatably inserted on the axle 52 fastened to the axle base stand 51. By this arrangement, sliding between the long holes 56 and axles 57, 58 in the above-described embodiments is eliminated and completely replaced by rotation between axles and holes. Therefore, the effects of loads by sliding, noise, wear and the like can be reduced.

Figure 13:
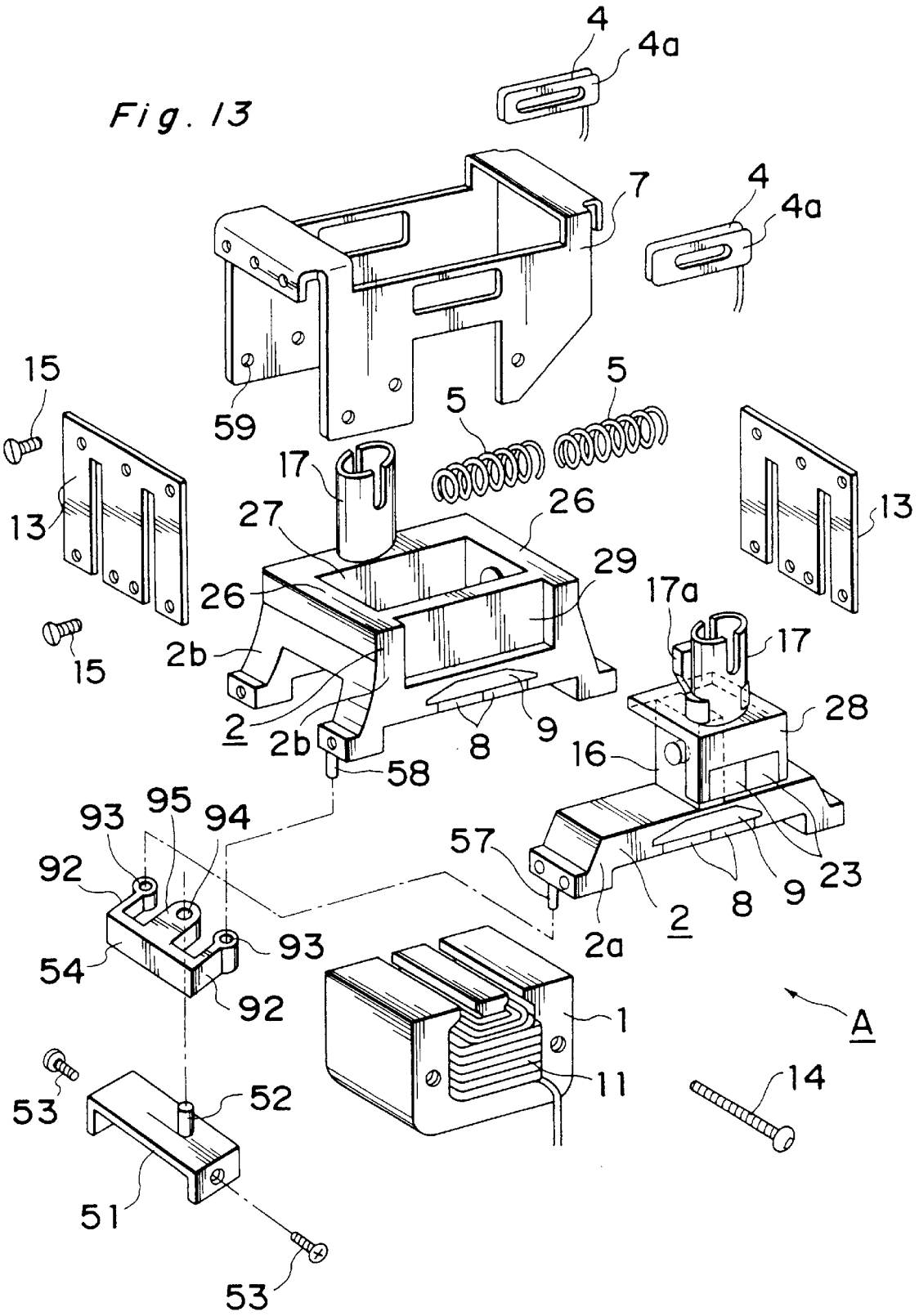
FIG. 13 is an exploded perspective view of still another embodiment of the present invention.

FIG. 13 shows still another embodiment of the present invention. In this embodiment, an elastic thin plate section 92 is provided on the link 54. More specifically, on both end portions of the link 54, elastic thin plate sections 92 are provided. On the tip end portions of said thin plate sections 92, holes 93 wherein axles 57, 58 are rotatably engaged are provided. On the central portion of the link 54, a protruding piece 85 is provided and on the tip end portion of said protruding piece 95. A central hole 94 wherein the axle 52 is rotatably engaged is provided. Both end holes 93 and the central hole 94 are arranged on the same line. In this arrangement the fluctuation in the intra-axle distance between axles 57 and 58 accompanying the vibrations of movable components 2 can be adjusted by elastic thin plate sections 92, resulting in reduction of the number of parts involved and elimination of sliding. Furthermore, the engagement portions may be reduced in number as compared with the case of providing auxiliary links. These arrangements are effective for reduction of loads and.

Figure 14:
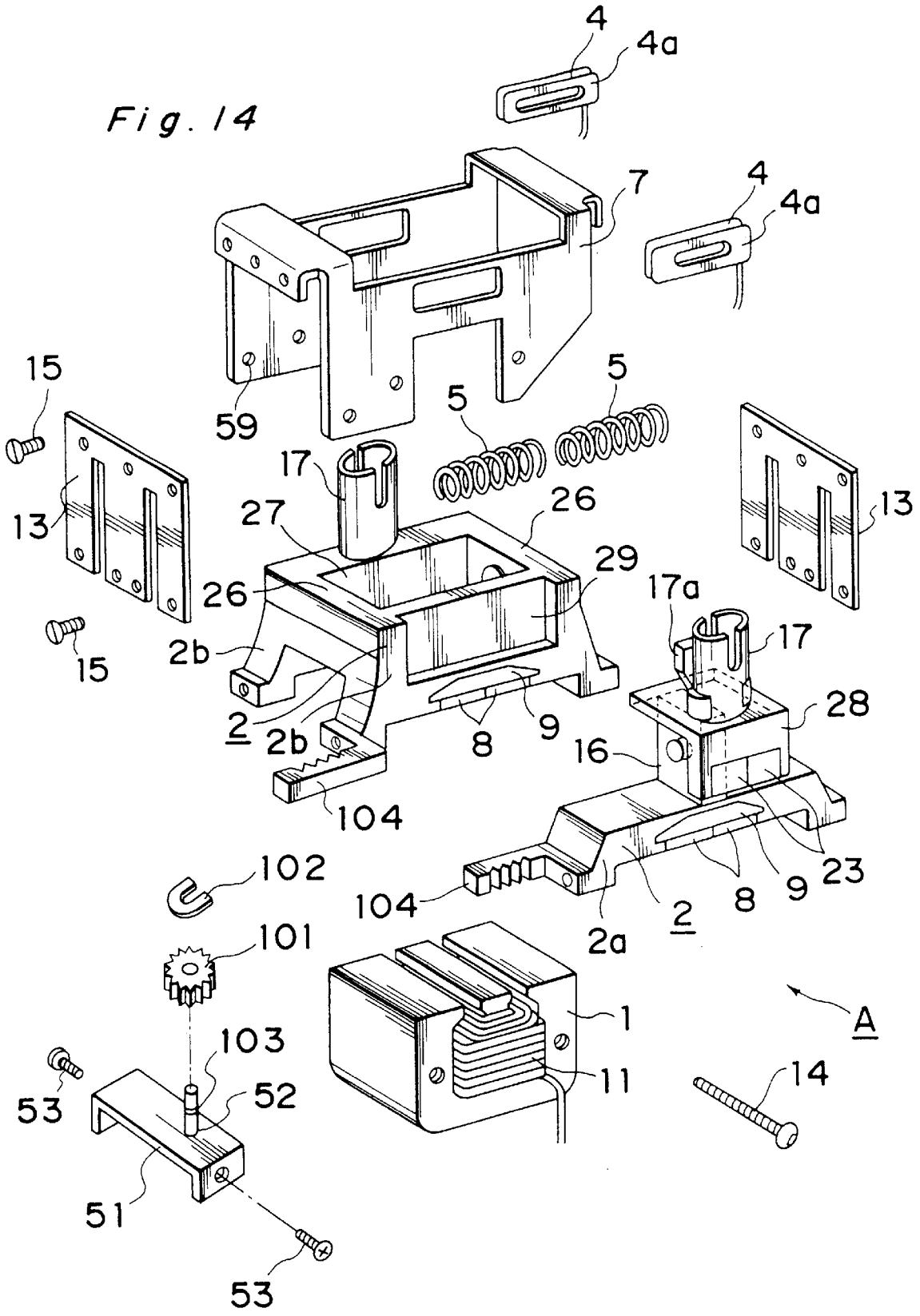
FIG. 14 is an exploded perspective view of still another embodiment of the present invention.

FIG. 14 shows still another embodiment of the present invention. In this embodiment, rack gears 104 are provided respectively on the movable components 2 arranged in the opposite phase relation with each other. A pinion gear 101 is rotatably mounted on the axle 52 fastened to the axle base stand 51. Reference numeral 103 denotes a recess provided on the axle 52. On this recess 103, a retaining fitting 102 is installed to prevent the pinion gear 101 from getting out of the axle 52. With the pinion gear 101, two rack gears 104 mesh so as to be driven in the directions opposite to each other. This arrangement has the same function as the link, i.e., when any one of the movable components 2 moves the other movable component 2 moves in the opposite direction.

Figure 15:
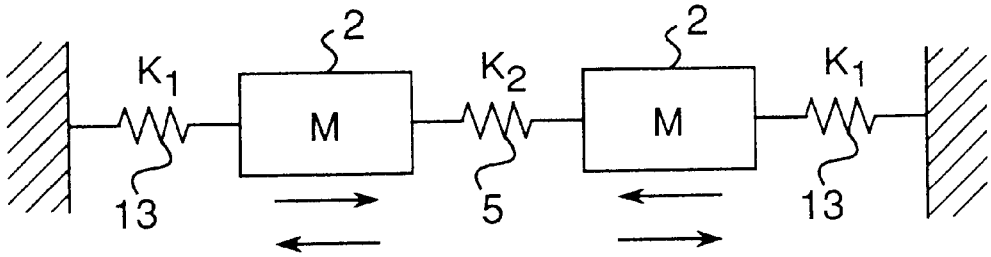
FIG. 15 is a schematic diagram of a spring vibration system wherein movable components are connected and supported to the chassis which is a stationary portion by spring members and both movable components are connected together with a connection spring.
Figure 16:
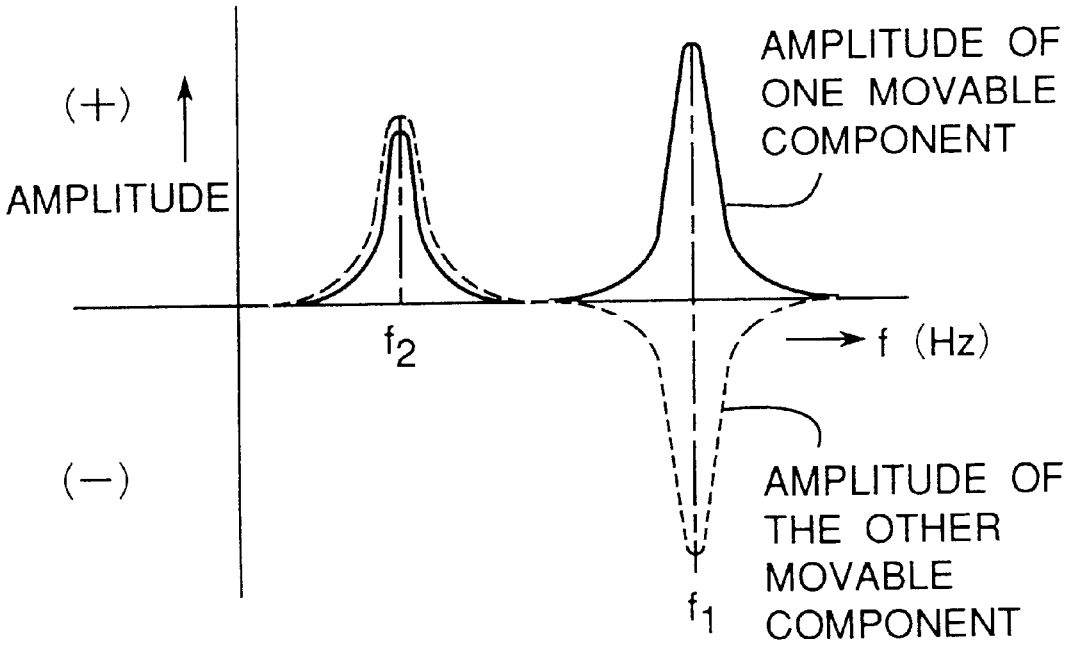
FIG. 16 is a graph representing vibration modes of respective movable components when a vibration exciting force of a constant frequency is applied to said vibration system.

Each of the above-described embodiments is arranged so that by one stationary component 1, two movable components are driven at the same frequency and in opposite directions, the vibration of the motor A and the vibration transmitted to a hand are together reduced. Furthermore, each of the above-described embodiments is arranged so that the movable component 2 is connected and supported onto the chassis 7, which is a stationary section, by spring members only, and both movable components 2 are connected to each other via connection springs 5. The schematic diagram of this configuration is shown in FIG. 15. In this model, there exist two vibration models. In the normal drive, because both movable component are driven at the drive mode $f_1$ wherein those movable components 2 move in opposite directions, the vibration as a whole does not take place. However, when a load is applied to the movable component 2 due to the cut of moustache and the like, while vibrating in the opposite directions at the $f_1$ mode, the $f_2$ mode wherein both movable components 2 move in the same direction takes place transiently, which raises the difference in amplitude between both movable components 2. Assuming the mass of both movable component as M, the spring constant of the spring member 13 as $k_1$ and the spring constant of the connection spring 5 as $k_2$, $f_1$ (Hz)=(½π)·$[(k_1+2k_2)/M]^{1/2}$ and $f_2$ (Hz)=(½π)·$2(k_1/M)^{1/2}$. And the amplitudes of respective movable components 2 in the case where a vibration exciting force of a certain frequency is applied thereto are represented by a graph shown in FIG. 16. Because the $f_2$ mode wherein both movable components move in the same direction takes place transiently, the motor A vibrates in the vibration direction of the movable components 2, which is transmitted to the whole electric shaver and gives a vibration causing unpleasant feeling to a shaver's hand. However, by connecting both movable components 2 which are in the opposite phase relations between each other via a link mechanism rotatably mounted the fastened axle 52, when an external force is applied to any one of both movable components 2 arranged in the opposite phase relations, the amplitudes of both movable components 2 are regulated between each other by the link 54. Thus, the occurrence of non-steady vibration can be curbed.

Figure 17:
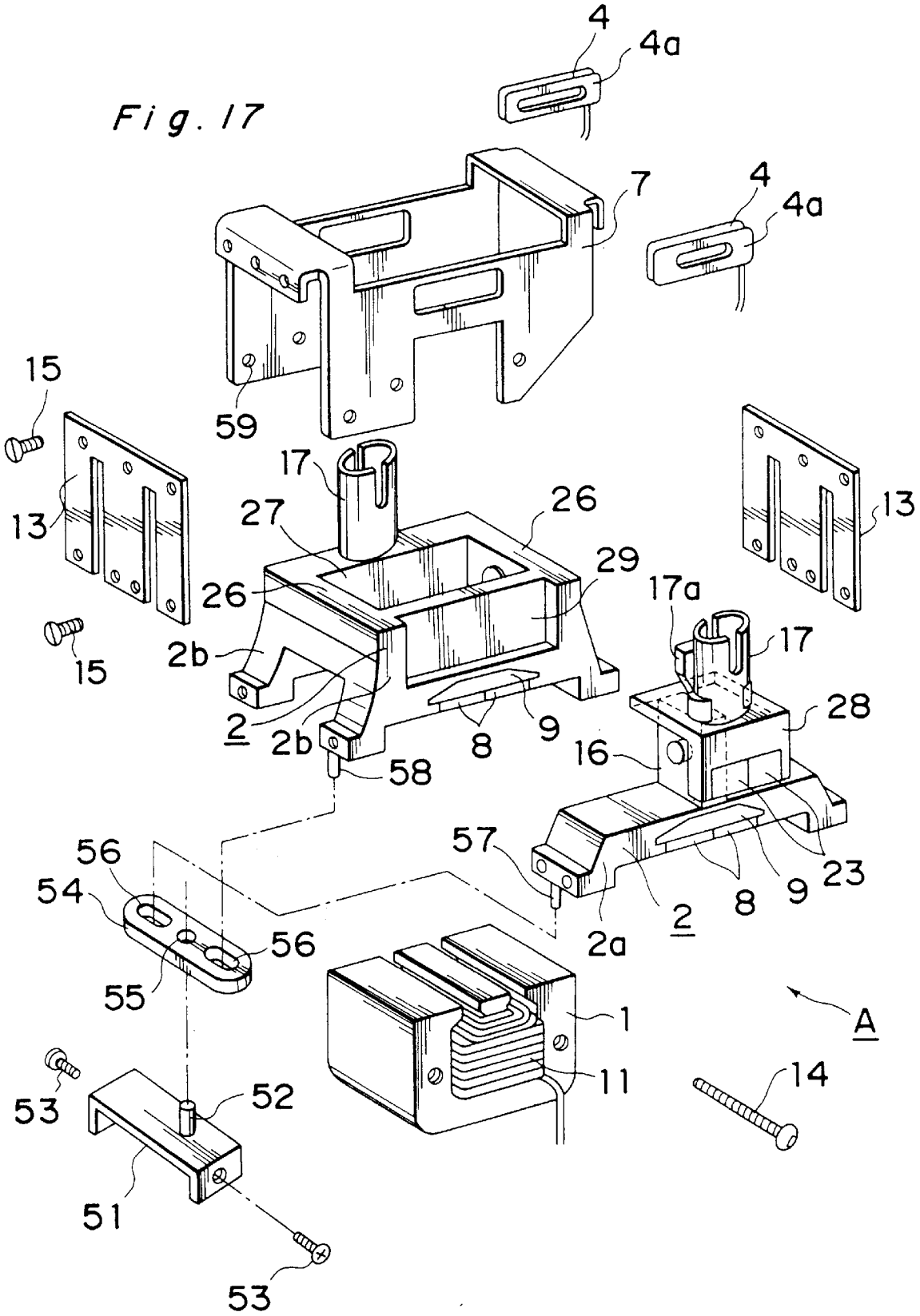
FIG. 17 is an exploded perspective view of still another embodiment of the present invention.

While an example wherein both movable components 2 are connected together with connection springs 5 is shown in the above-described embodiments, an example wherein no connection spring which is the spring for setting the natural frequency is provided is shown in FIG. 17. Because both movable components 2 are connected with a link 54 in this embodiment, even when a load is applied to one of both movable components 2, the drive force of the other movable component 2 is transmitted via the link 54, even in the state where the connection spring which is the spring for setting the natural frequency is not provided, a stable and sharp shaving of blade can be insured and no connection spring being present. This embodiment is superior for space consideration, cost and ease of assembly.

Furthermore, while an example wherein both movable components 2 are supported on the fastened section by spring members 13 is shown in the above-described embodiments, the present invention is applicable to a case wherein both movable components are supported by a contact structure by providing bearings between the movable components 2 and stationary portions.

What is claimed is:

1. A vibratory linear actuator comprising:

a reciprocating motor having a stationary component and a plurality of movable components capable of reciprocating vibrations, said plurality of movable components vibrating reciprocatingly relative to said stationary component at a same frequency and in opposite phase relations with each other, the reciprocating vibrations generated by an electromagnetic source; and a link mechanism which connects both movable components to transmit vibration of one of said plurality of movable components to another of said plurality of movable components by reversing a vibration direction thereof said link mechanism causing said movable components to vibrate in opposite phase.

2. A vibratory linear actuator as described in claim 1, wherein said link mechanism comprises a link rotatably supported on a fixed axle.

3. A vibratory linear actuator as described in claim 2, wherein a support point of said link and connection points of the link with respective ones of said plurality of movable components are positioned on the same line.

4. A vibratory linear actuator as described in claim 2, wherein the ratio of the distances between the support point of the link and the connection points of the link are substantially equal to the ratio of the amplitudes of respective ones of said plurality of movable components in a state where no link is provided.

5. A vibratory linear actuator as described in claim 2, wherein the ratio of the distances between the support point of the link and the connection points of the link with respective ones of said plurality of movable components is substantially equal to an inverse ratio of respective masses of ones of said plurality of movable components.

6. A vibratory linear actuator as described in claim 2, wherein connection portions of said plurality of movable components with said link comprise axles received in long holes.

7. A vibratory linear actuator as described in claim 6, wherein a lengthwise edge of each long hole has an amplitude restriction portion for limiting the amplitude of each of said plurality of movable components to within a predetermined range by contact of said axles with said amplitude restriction portion.

8. A vibratory linear actuator as described in claim 2, wherein auxiliary links are interposed between the link and respective ones of said plurality of movable components.

9. A vibratory linear actuator as described in claim 2, wherein said link is provided with elastic thin plate sections.

10. A vibratory linear actuator as described in claim 2, further comprising a link pressing spring which elastically urges the link in a predetermined rotational direction.

11. A vibratory linear actuator as described in claim 1, wherein said plurality of movable components are respectively provided with rack gears meshed with a pinion gear rotatably mounted on a fixed axle so as to drive in opposite directions.

12. A vibratory linear actuator as described in claim 1, wherein each of said plurality of movable components is swingably supported on a fixed portion by a spring member and connected in opposite phase relations with each other with a connection spring.

13. A vibratory linear actuator comprising:

a reciprocating motor which is provided with a stationary component including an electromagnetic member;

a plurality of movable components each including a permanent magnet, said plurality of movable components being arranged in parallel to each other and each supported by a spring mechanism, so as to vibrate reciprocatingly, said plurality of movable components positioned to confront the stationary component and being spaced from the stationary component by a gap, the stationary component generating electromagnetic energy for periodically vibrating said plurality of movable components;

at least one connection spring coupling two adjacent movable components to establish an energy transmitting connection between said adjacent movable components, said at least one connection spring forming a vibration system together with the spring mechanism;

said vibration system having a first vibration mode in which the two adjacent movable components vibrate in an opposite phase and a second vibration mode in which the two adjacent movable components vibrate in a same phase; and a link mechanism that links said plurality of movable components to cause the movable components to vibrate in the first vibration mode.

14. The vibratory linear actuator according to claim 13, wherein said plurality of movable components are each provided with rack gears meshed with a pinion gear rotatably mounted on a fixed axle so as to drive in opposite directions.

15. The vibratory linear actuator according to claim 13, wherein said link mechanism comprises a link rotatably supported on a fixed axle.

16. The vibratory linear actuator according to claim 15, wherein auxiliary links are interposed between the link and respective ones of said plurality of movable components.

17. The vibratory linear actuator according to claim 15, wherein the link is provided with elastic thin plate sections.

18. The vibratory linear actuator according to claim 15, further comprising a link pressing spring which elastically urges the link in a predetermined rotational direction.

19. The vibratory linear actuator according to claim 15, wherein a support point of the link and connection points of the link with respective ones of said plurality of movable components are positioned on the same line.

20. The vibratory linear actuator according to claim 19, wherein the ratio of the distances between the support point of the link and the connection points of the link are substantially equal to the ratio of the amplitudes of respective ones of said plurality of movable components in a state where no link is provided.

21. The vibratory linear actuator according to claim 19, wherein the ratio of the distances between the support point of the link and the connection points of the link with respective ones of said plurality of movable components is substantially equal to an inverse ratio of respective masses of ones of said plurality of movable components.

22. The vibratory linear actuator according to claim 19, wherein the connection portions of said plurality of movable components with said link comprise axles received in long holes.

23. The vibratory linear actuator according to claim 22, wherein a lengthwise edge of each long hole has an amplitude restriction portion for limiting the amplitude of each of said plurality of movable components to within a predetermined range by contact of the axles with the amplitude restriction portion.

* * * * *